US005947320A

United States Patent [19]

Bordner et al.

[11] Patent Number: 5,947,320

[45] **Date of Patent: *Sep. 7, 1999**

[54] MOLDED DRUM, LID AND RING-CLAMP SYSTEM WITH ENHANCED CONTAINMENT INTEGRITY

[75] Inventors: Paul G. Bordner, Pickerington; Bret D. Bordner, Groveport, both of Ohio; Richard P. Brandt, Crystal Lake, Ill.

[73] Assignee: Containers Accessories, Inc., Gahanna, Ohio

[ * ] Notice: This patent is subject to a terminal disclaimer.

[21] Appl. No.: 08/988,894

[22] Filed: Dec. 11, 1997

[51] Int. Cl.[6] ..... B65D 45/34

[52] U.S. Cl. ..... 220/321; 220/803; 292/256.69

[58] Field of Search ..... 220/319–321, 220/378, 803, 804, 795; 292/DIG. 47, 256.6, 256.65, 256.69

[56] References Cited

U.S. PATENT DOCUMENTS

| | | | |
|---|---|---|---|
| 1,924,578 | 8/1933 | Vick | 220/321 |
| 3,091,489 | 5/1963 | Vaughn | 292/256.69 |
| 3,633,956 | 1/1972 | Angell | 292/256.69 |
| 3,664,544 | 5/1972 | Hammes | 220/320 |
| 4,651,892 | 3/1987 | Boersma | 220/320 |
| 4,674,650 | 6/1987 | Hamilton et al. | 220/320 |
| 4,678,216 | 7/1987 | Gregory | 292/256.69 |
| 4,946,064 | 8/1990 | VanCucha | 220/795 |
| 5,129,537 | 7/1992 | Bordner et al. | 220/321 |
| 5,713,482 | 2/1998 | Bordner et al. | 220/321 |

*Primary Examiner*—Stephen K. Cronin
*Assistant Examiner*—Nathan Newhouse
*Attorney, Agent, or Firm*—Mueller and Smith LPA

[57] ABSTRACT

A closure system including a polymeric split ring clamp and a polymeric lid for a polymeric drum. To maintain the integrity of the closure, the lid rim region is formed having an annular restraining notch which cooperates with twist inhibiting blocking components formed within the interior of a cooperating inwardly opening polymeric split ring clamp. The blocking component may be provided as a sequence of regularly spaced block-like protuberances located within the inward upwardly disposed region of the ring clamp. A secondary closure arrangement is provided with the split ring clamp which receives a polymeric banding strap to prevent one end of the split ring from disengaging with an associated pivot arm. When the split ring clamp is in a fully open or pre-clamping mode orientation, a capture groove is formed with the ring pivot shaft formed at one end of the split ring clamp. This capture groove is aligned with and engages a corresponding capturing pawl formed at the opening of the ring pivot shaft receiving notch. To facilitate cleaning and re-use, a polymeric gasket is provided which is removably insertable within a seal retainer cavity located at the rim of the lid.

34 Claims, 8 Drawing Sheets

MOLDED DRUM, LID AND RING-CLAMP SYSTEM WITH ENHANCED CONTAINMENT INTEGRITY

BACKGROUND OF THE INVENTION

Cylindrical containers intended for retaining chemicals, industrial materials, and the like, when configured in larger, drum sizes generally are structured either of a metal such as steel or, particularly in North America, of a fiber material. Such fiber drums are formed having a metal chime and a replaceable lid which typically is retained in position by a split ring clamp. Other regions of the globe, particularly Europe and the Far East, form such non-metallic varieties of drums of a plastic rather than fibrous material. With the rapid globalization of commerce, a trend toward a somewhat universal use of plastic material for fabricating drums and associated lids has been observed. In this regard, there are ecological advantages associated with such uses of plastic, the material forming the drums and lids, for the most part, being recoverable. International standards also are developing which may supplant national standards for the performance of these drums. In this regard, standards have been promulgated by the United Nations organization. Department of Transportation Standards typically called for a 45° inverted drop test from a height of 4 feet wherein the drums are filled with dry, finely powdered material to an authorized net weight in a lid. Depending upon the U.N. standards involved, the containers then are called upon to withstand a 45° inverted drop from varying heights onto a hard surface such as concrete. The varying heights of 2 feet, 4 feet, and 6 feet are classified as X, Y, and Z. Classification of the proper designation for a container, which appears on the drum, for example Y-150 indicates that the container passes a 4 feet inverted drop with 150 Kg of dry product. To pass such tests or standards, the drum and lid combinations must recover from such drops without rupture or leakage. One international test approach involves a similar drop test except that the drums are filled with water instead of powdered materials. Such tests also include a seal test wherein the drums are filled with water, laid on their sides on a horizontal surface to determine the presence of leakage. Another test for leakage is the tip over test. In this test, a drum filled with water with lid and lockband properly installed is placed on a shipping pallet having a height of 4 inches. The conntainer is then pushed over allowing the container to fall on its side. In this test, no seepage of water is to occur.

Lids typically enclosing the drums are formed as stamped metal, fiber or plastic components which are secured over the rim-chime assemblies with metal split ring clamps having a channel or U-shaped cross section, the lower inwardly turned side or edge of which engages a rim or groove of the lid-drum interface and the upper side of which abuts over the lid top. An over-center lever generally is used to draw the ends of the split ring clamp structure together. For many packaging, transportation, and incinerator container applications, industrial users of such structures have sought to avoid metal components such as lids and lid retainers including the split ring clamping device. These metal devices do not burn, are prone to corrode, or, importantly, to insert minute metallic contaminants with the material packaged within the containers. Plastic lids have been successfully developed, for example as described in U.S. Pat. No. 4,718,571, by Bordner and for some period of time, the development of corresponding plastic clamping rings which remain competitive in terms of cost and securement performance was an elusive objective for investigators, until Bordner, et al., evolved a successful all plastic polymeric two-piece split ring clamp. This clamp, which found success in conjunction with fiber type drums, is described in U.S. Pat. No. 5,129,537, issued Jul. 14, 1992, and entitled "Two-Piece Polymeric Lid Clamping Ring".

The plastic lids and split ring clamps heretofore developed have performed quite well in combination with inherently rigid fiber drums. However, their experimental application to plastic drums has demonstrated a need for greater strength. An improved, two piece polymeric split ring clamp suited for use with the all plastic container combination is described in co-pending application for United States patent entitled "Polyermic Split Ring Clamp" by Bordner, et al., filed May 2, 1996 Ser. No. 08/643,249 (now U.S. Pat. No. 5,713,482, issued Feb. 3, 1998).

Another important aspect of the all plastic container systems resides in their reusability. Inasmuch as the drums are formed entirely of polymeric material, they may be cleaned and reused to achieve a substantial financial savings. However, this economically desirable reusability feature has not been available in the case of lids. To be practically cleanable utilizing automated scrubbing systems, crevices or like geometric configurations which would require manual cleaning procedures should be avoided. Otherwise, the cleaning cost renders the reuse feature unfeasible. Another block to lid reusability or reconditioning has been associated with the removal of the polymeric gasket functioning as a seal between the lid and an associated drum. Traditionally, this gasket has been formed of polyurethane which is fabricated in situ within the lid rim structure. Because of its adherence to the lid, the removal of such gaskets as a part of a cleaning process has been impractical to further defeat the otherwise desirable attainment of a reusable lid.

In 1996, Bordner, et al. introduced a molded plastic lid which achieved an enhanced strength in combination with improved cleanability by utilizing a structure wherein the central or intermediate region of the lid is configured as a sequence of waves which extend with gradually increasing amplitude from the lid center to a peripheral ring band. That ring band nests against the inside wall of the top portion of an associated drum when the lid is installed. Additionally, the structural integrity of this lid is enhanced by the fashioning of its center portion in a manner wherein the wave crest edges define a shallow dome. The smoothly transitioning crest-trough geometry promotes cleanability and thus, its practical reusability. To complement this cleanability feature of the configuration of the lid, its rim structure is fashioned in concert with a removably installed polymeric gasket. The gasket is provided having a ring seal portion which is removably insertable within a sealing cavity located at the rim of the lid. This ring seal may be extruded with a thermoplastic rubber exterior skin and an internally disposed foamaceous material. The waveform lid is described by Bordner, et al., in application for United States patent Ser. No. 08/643,236, entitled "Molded Lid with Wave Configured Central Portion", filed May 2, 1996, now U.S. Pat. No. 5,785,201, issued Jul. 28, 1998.

Plastic drum, lid, and ring clamp systems of design permitting reuse now are the subject of substantial interest on the part of industries where avoidance of product contamination is of paramount importance. For example, relatively large drums are used in the food processing industry for intra-company transportation from growing regions to packing centers. These drums, which have lid diameters of about 24 inches, may weigh when loaded, about 600 pounds. Typically, the loaded drums are locally maneuvered by drum handling mechanisms having relatively small gripping devices which attach to a small region of the drum-lid-ring clamp interface and then elevate the drum above the surface for movement. Thus, an applied twisting moment at that small region may induce lid failure. Also, when attaching the popular polymeric two-piece clamp, the somewhat loose, preclamping mode configuration of the two-piece ring clamp may separate in the course of positioning the clamp about the lid and drum. This calls for reassembly of the clamp which, while remaining a simple procedure, often evokes frustration on the part of personnel, particularly those who are inexperienced with the process for attaching the ring clamp.

Drop testing of these all plastic drum-lid-ring clamp systems also has revealed a similar mode of failure wherein the ring clamp and lid rim structures tend to twist upwardly in failure, a phenomenon sometimes referred to by testing personnel as "peeling".

BRIEF SUMMARY OF THE INVENTION

The present invention is addressed to a closure system for containers wherein a split ring clamp is structured in concert with a lid outer periphery in an arrangement achieving a desirably high level of structural integrity. Retaining the advantages of earlier all plastic systems, the split ring clamp component is formed of a minimum number of parts. A secondary closure system is provided wherein a banding strap additionally may be employed to reinforce the closure aspects of the system. Further, the lid of the system is designed to permit facile and economic cleaning permitting its reuse.

Enhanced structural integrity of the closure system is achieved by combining an annular restraining notch along the rim structure of the lid in conjunction with a twist inhibiting blocking component located within the inwardly opening interior of an associated split ring.

In order to avoid the annoyance of having one end of the split ring part from the ring pivot arm when in an open orientation or pre-clamping mode, the oval ring pivot shaft is formed having a capture groove. This capture groove engages a capturing pawl located at the opening of the ring pivot shaft receiving notch above the pivot arm when that arm is at a full but controlled open orientation. The controlled orientation is realized by the incorporation of sloping ring contact surfaces with the pivot shaft receiving notch formed at one end of the split ring. Such ring contact surface engages a corresponding abutting surface on the upper edge of the pivot arm to position the arm in a manner aligning the capture groove with the capturing pawl.

Other objects and features of the invention will, in part, be obvious and will, in part, appear hereinafter.

The invention, accordingly, comprises the system and apparatus possessing the construction, combination of elements, and arrangement of parts which are exemplified in the following detailed disclosure.

For a fuller understanding of the nature and objects of the invention, reference should be had to the following detailed description taken in connection with the accompanying drawings.

DETAILED DESCRIPTION OF THE INVENTION

Figure 1:
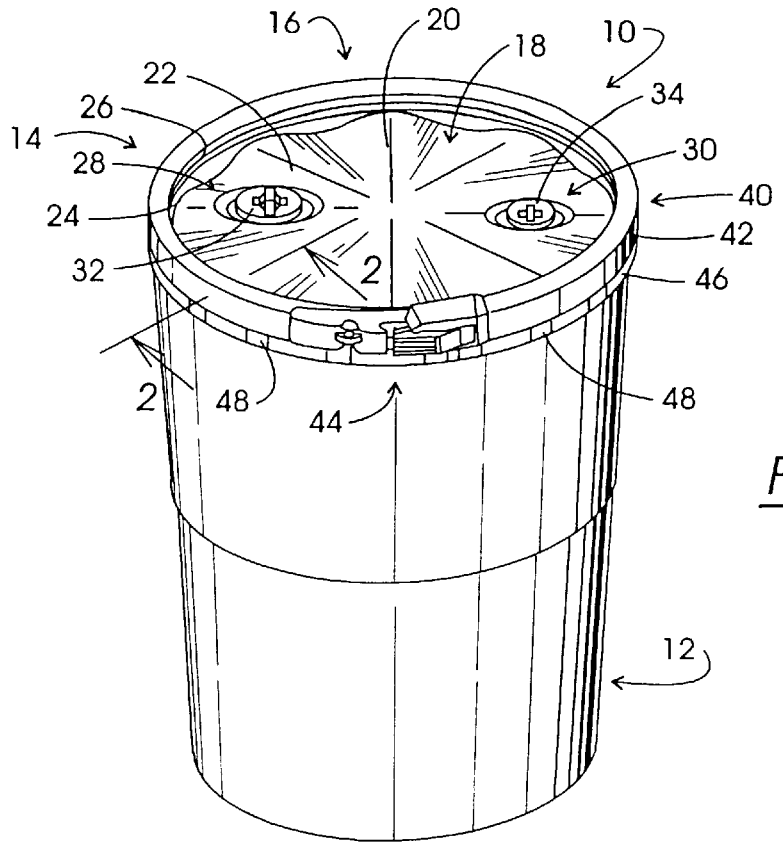
FIG. 1 is a perspective view of a plastic drum and lid assembly utilizing a closure system according to the invention.

Looking to FIG. 1, a drum and lid assembly is represented generally at 10. The drum component of assembly 10, as shown at 12, typically will be blow molded or injection molded with a high density polyethylene, and configured such that the sidewall can be straight-sided or tapered inwardly toward the drum bottom. Typically, the bottom surface is configured with a slight upward bow both to enhance seating of the drum on a surface and to avoid downward flexure. No metal tines or the like as may be found with fiber drums are present in the plastic drum construction. Drum 12 is shown to be closed with a closure system shown generally at 14 which includes a molded lid represented generally at 16. Lid 16, formed of a high density polyethylene, includes a top portion represented in general at 18 having a lid center 20 and an intermediate region 22 extending to an outer periphery 24 which includes an annular rim structure. The intermediate region 22 is configured as a sequence of a predetermined number of waves, each of curved cross-section and defining successively occurring crests and troughs. These waves increase in amplitude from the lid center 20 toward the outer periphery 24. For the embodiment illustrated, eight such waves are utilized. Intermediate region 22 is seen to terminate at a ring band 26 within outer periphery 24.

Diametrically oppositely disposed upon wave crests within the intermediate region 22 are two bung assemblies 28 and 30. Assemblies 28 and 30 are molded having threaded apertures extending through the lid top portion 18 and each receives a corresponding closing threaded fitment respectively shown at 32 and 34. It is preferred that the bung assemblies 28 and 30 be positioned at a wave crest of the intermediate region 22, and this is achievable by having an even integer number of wave crests. Typically, the bung assembly 28 has an nominal diameter of 2 inches, while bung assembly 30 has a nominal diameter of about ¾ inch. Generally, the assemblies 20 and 30 serve the function, respectively, of filling or pouring and venting. Lid 16 may be fabricated with or without bung assemblies as determined by the user.

Lid 16 is secured to the top structure of drum 12 by a split ring clamp represented generally at 40. Clamp 40 is formed of polymeric material, for example, a high molecular weight, high density polyethylene copolymer such as type HYA-24 marketed by Mobil Polymers, U.S., Inc. The material exhibits excellent impact strength and stress crack resistance suited for high performance tank and drum applications. For added integrity and endurance under adverse sun conditions, the clamp, as well as lid and drum material, may incorporate a U.V. (ultraviolet) screen.

In general, the clamp assembly 40 includes an inwardly-opening channel-form ring 42 and a pivot arm represented generally at 44. Integrally formed with the ring 42 is a secondary connection flange represented generally at 46 which supports a band retainer assembly formed of a sequence of outwardly depending spaced-apart belt loops, certain of which are revealed at 48. Inserted through these belt loops and about the band retainer assembly is a nylon banding strap of conventional design which is retained in tension by a conventional crimping arrangement.

Figure 2:
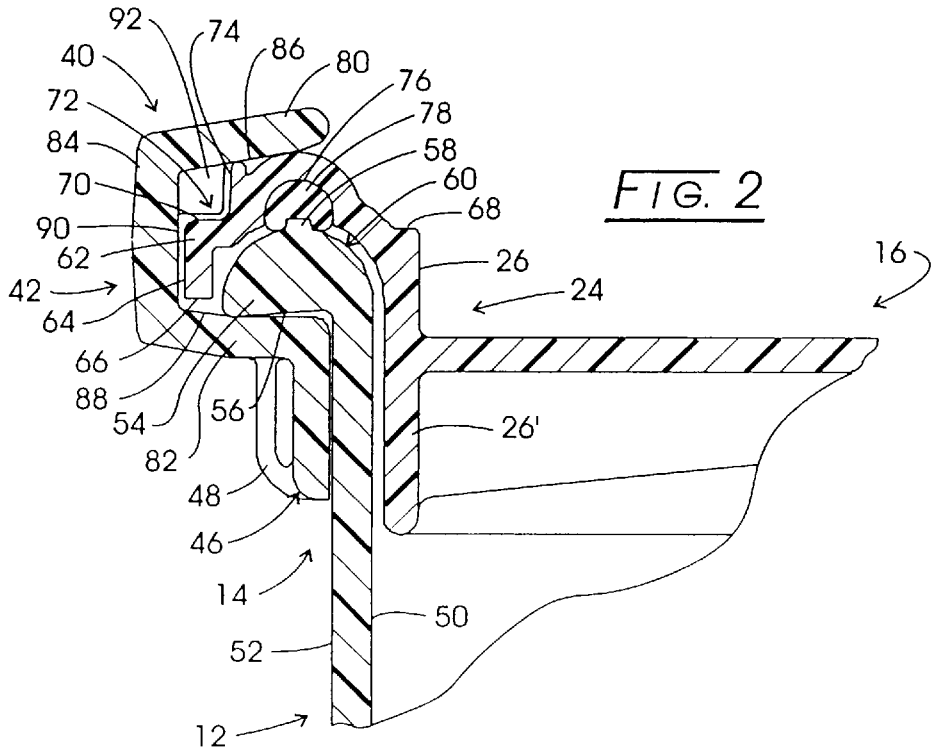
FIG. 2 is a partial sectional view taken through the plane 2—2 in FIG. 1.

Turning to FIG. 2, the complementing structures of the lid outer periphery 24 and the split ring clamp 40 are revealed. It may be noted that the upper portion of the drum 12, including the inwardly and outwardly disposed wall surfaces shown, respectively, at 50 and 52 extend to an integrally formed polymeric chime 54 having a generally semi-circular cross-section with a flat underside 56 and an annular expanion rib 58 protruding upwardly therefrom.

Looking to the outer periphery 24 of lid 16, the ring band 26 is seen to extend downwardly as at 26' in adjacency with the inwardly disposed wall surface 50 of drum 12. Outwardly of the band 26, there is integrally formed an annular concave closure cavity represented generally at 60 which nestably extends over or receives the container rim or chime 54. The rim structure also includes an outwardly disposed annular flange portion 62 which is seen having a lower disposed annular outer flange surface 64.

Flange portion 62 extends downwardly from an annular ledge surface 70 forming one surface of an annular restraining notch represented generally at 72. Notch 72 is further defined by an annular upstanding surface 74.

Additionally positioned within the annular concave closure cavity 60 is an upwardly disposed concave annular seal retainer cavity 76 within which is removably located a polymeric gasket 78. Gasket 78 is press fitted into the retainer cavity 76. In this regard, to provide for its retention, the cavity 76 is configured having a cylindrical surface extent subtending an angle greater than 180° but, less than 360° by so configuring cavity 76, an access slot is developed at its entrance. That access slot has a widthwise (radial) dimension less than the diameter or principal widthwise dimension of the cavity itself. Thus, the gasket 78 is retained without resort to an adhesive. Note that the expansion rib 58 tends to expand the flexible gasket 78 as it compressively extends into it.

Figure 3:
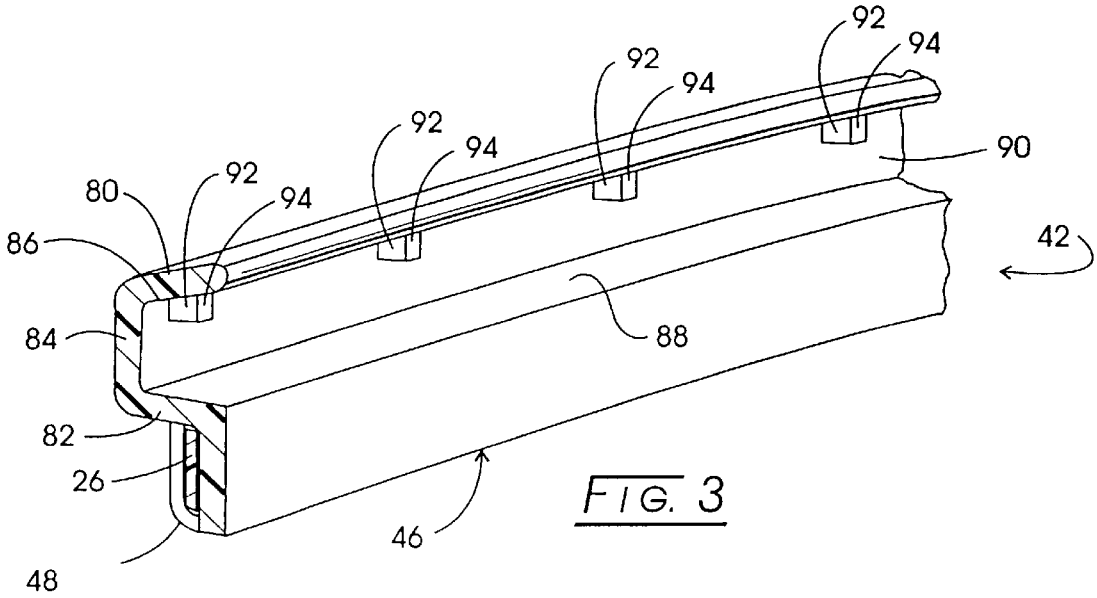
FIG. 3 is a partial perspective view of a ring component employed with the invention.
Figure 4:
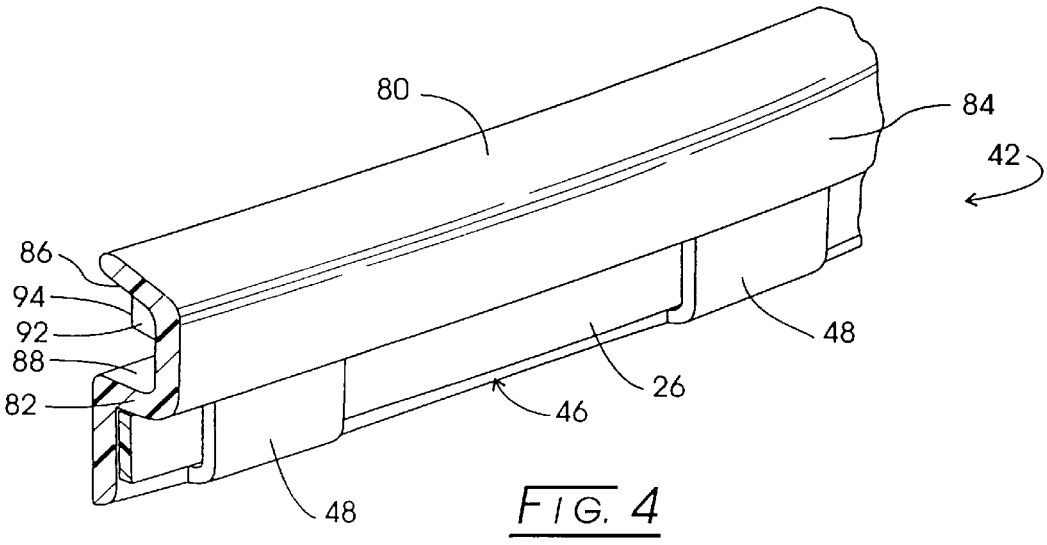
FIG. 4 is a perspective view of the component shown in FIG. 3 but looking to an outwardly disposed face thereof.

Polymeric clamp ring 42 is formed having an upper side flange portion 80 and a lower side flange portion 82 which extend inwardly from an outer band portion 84. The inner surfaces of side flange portions 80 and 82 are shown, respectively, at 86 and 88, while the inner surface of outer band portion 84 is shown at 90. Extending from the inner surfaces 90 and 86 is a blocking component 92. The blocking component 92 is provided as a sequence of block-like protrusions or gussets extending integrally from the inner surfaces 86 and 90. Each of the blocking components 92 provides an inwardly disposed surface 94. Referring additionally to FIGS. 3 and 4, the blocking components 92 are seen to be provided as block-like protuberances which are radially spaced about the ring 42 in increments of about 10°.

Figure 5:
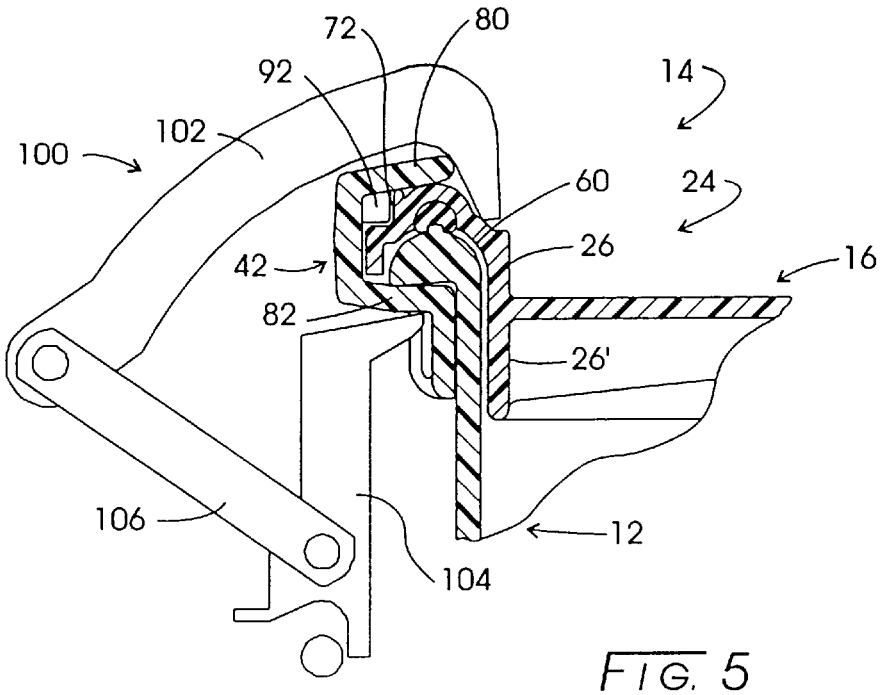
FIG. 5 is a partial sectional view of a drum and closure system according to the invention being maneuvered by a drum handling device.
Figure 6:
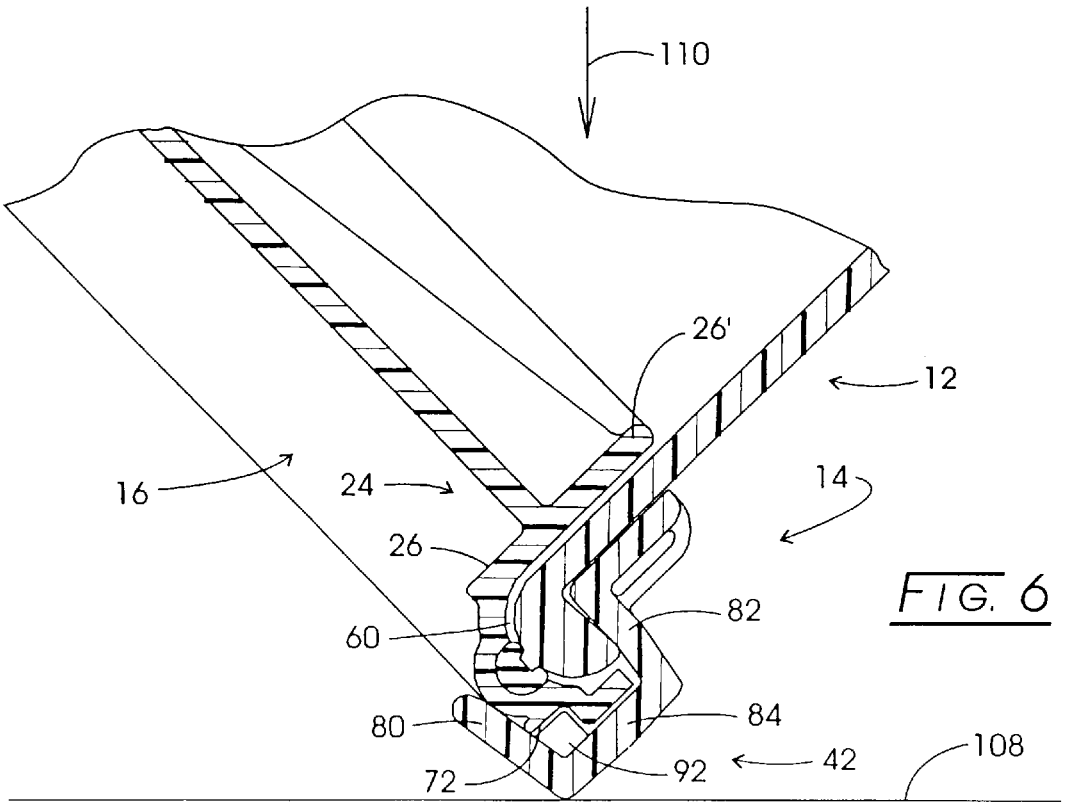
FIG. 6 is a partial sectional view illustrating the orientation of a drum employing the closure system of the invention in the course of a 45° inverted drop test.

The combination of the restraining notch 72 and blocking components 92 functions to provide a substantial improvement in retention of the lid 16 upon the drum 12 under severe handling or testing. Depending upon the mode of stress imposed, for example, the annular upstanding surface 74 of restraining notch 72 may engage the inwardly disposed surfaces 94 of the blocking components 92 to establish what may be considered a pivot point. Other restraining geometries also may be developed depending upon the direction of stresses imposed. Looking at FIGS. 5 and 6, conditions upon which the closure system has been found to be effective are represented. In FIG. 5, a drum 12, lid 16, and closure system 14 are seen being lifted, typically under filled conditions, by a drum transporter which grips the polymeric split ring clamp 42 and associated lid 16 with a relatively narrow pincher like gripping arrangement. In this regard, the gripping arrangement includes an upper gripping component 102 and lower gripping component 104 which are linked, for example, by a cross-link 106. The filled drum 12 abuts against the transporter 100 at a lower region as it is lifted a few inches above an industrial facility floor. Such devices have been referred to as "parrot beak technology" and are marketed, for example, by Liftmatic of Evanston, Ill. The closure assemblies also are called upon to retain the lid 16 upon the drum 12 under 45° inverted drop tests. Such a drop test is illustrated in FIG. 6 wherein the combined drum 12, lid 16, and closure system 14 are dropped upon a concrete floor 108. Closure must be maintained under the forces of this drop as are represented at arrow 110.

Figure 7:
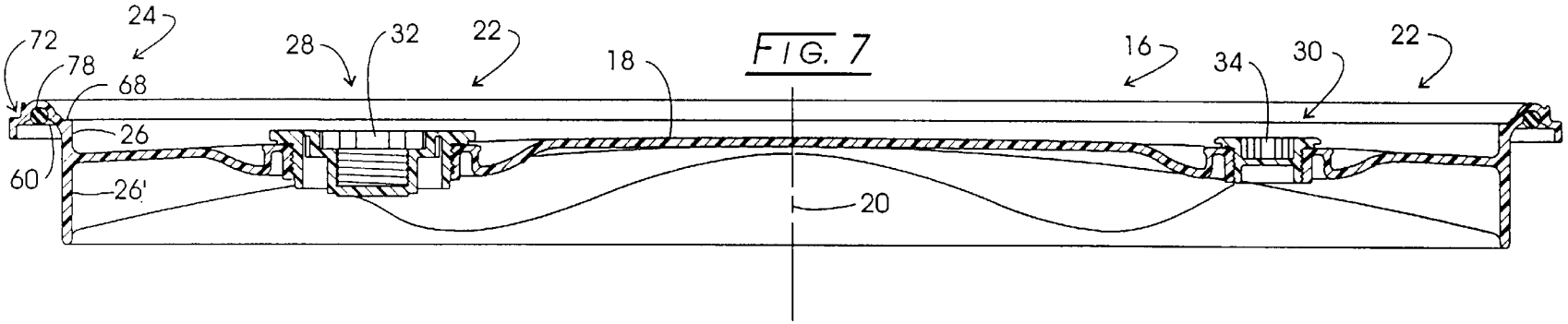
FIG. 7 is a sectional view of the lid component carrying the closure system of the invention.
Figure 8:
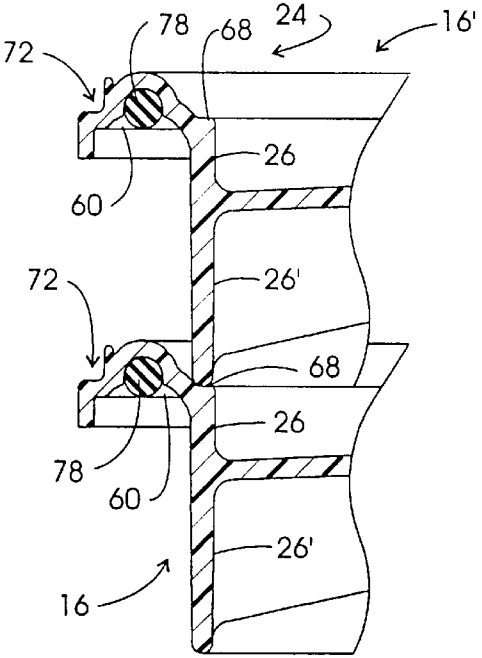
FIG. 8 is a partial sectional view showing a stacking relationship for lids configured in accordance with the invention.
Figure 9:
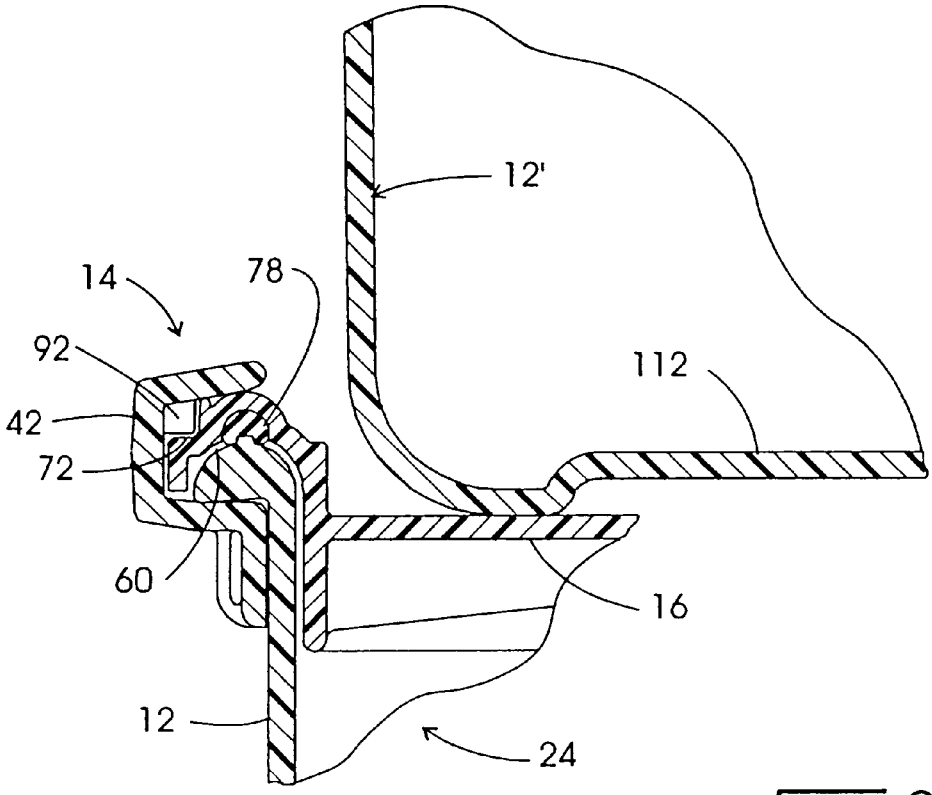
FIG. 9 is a parrtal sectional view showing a drum stacking arrangement for drums employing the closure system of the invention.

Looking to FIG. 7, the lid 16 is illustrated in its entirety. It may be observed that the outer periphery 24 of the lid is configured having an annular lid stacking ledge 68 which advantageously permits the lid 16 to be stacked for shipping. In this regard, the lower component 26' of the ring band 26 stacks upon the ledge 68 in the manner shown in FIG. 8. In that figure, a lid 16' is seen stacked upon lid 16 at stacking ledge 68. Looking to FIG. 9, a drum-upon-drum stacking arrangement is depicted wherein a drum 12' is positioned upon the lid 16 covering a drum 12. In this regard, the lower portion 112 of the drum 12' is seen positioned upon lid 16 at the outer region or periphery 24.

Figure 10:
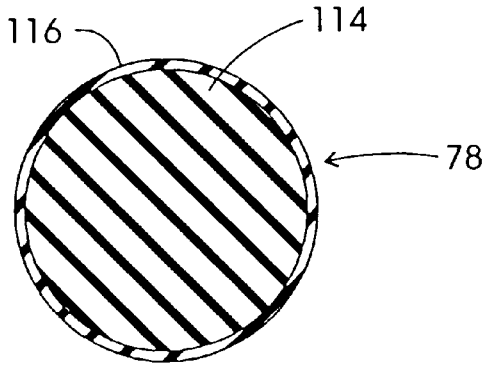
FIG. 10 is a sectional view of a polymeric gasket employed with the lid component of the invention.

Referring to FIG. 10, the polymeric gasket 78 intended for removable insertion within the concave annular seal retainer cavity 76 is shown in cross-section. The gasket 78 preferably is made from a 60 Shore A durometer thermoplastic elastomer (TPE) or thermoplastic vulcanizate (TPV) which is a vulcanized blend of EPDM rubber and polypropylene at the core 114. The outer skin 116, by contrast, is formed of a 35 shore A TPE or TPV. Such low durometer allows the seal to curve more readily around the lid with more holding force. The flexible skin surface will easily conform to minor variations in the sealing surfaces in order to seal more securely. Gaskets as at 78 are marketed by Amesbury Group, Inc. of Amesbury, Mass.

Figure 11:
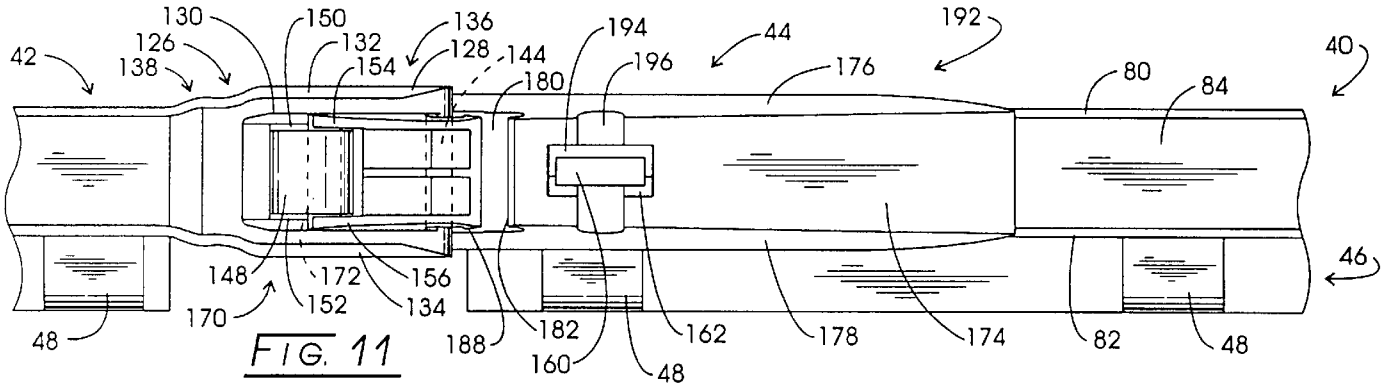
FIG. 11 is a partial side view of a split ring clamp employed with the invention showing the pivot arm component thereof.
Figure 12:
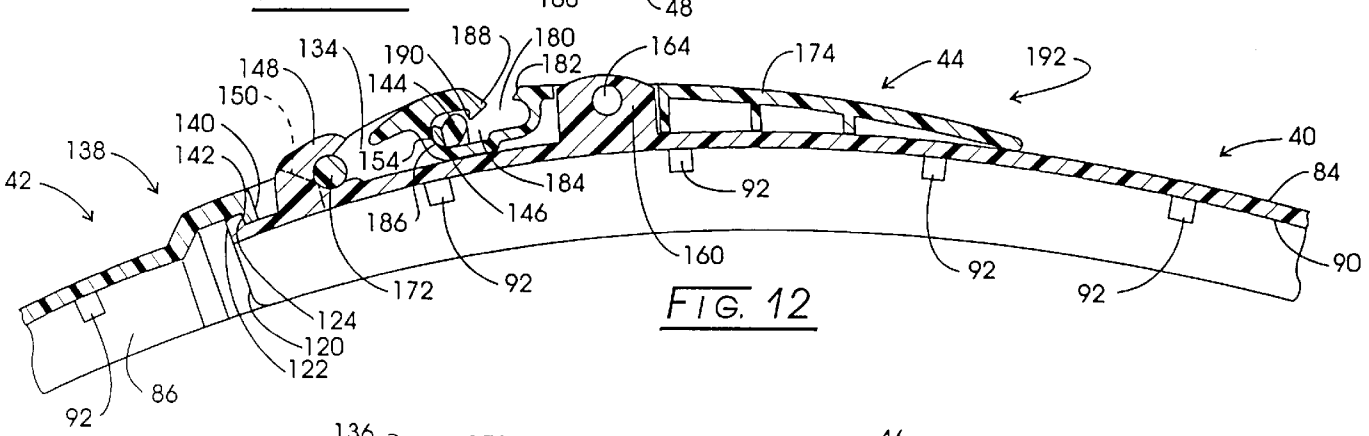
FIG. 12 is a partial sectional view of the two-piece split ring clamp of FIG. 11.
Figure 13:
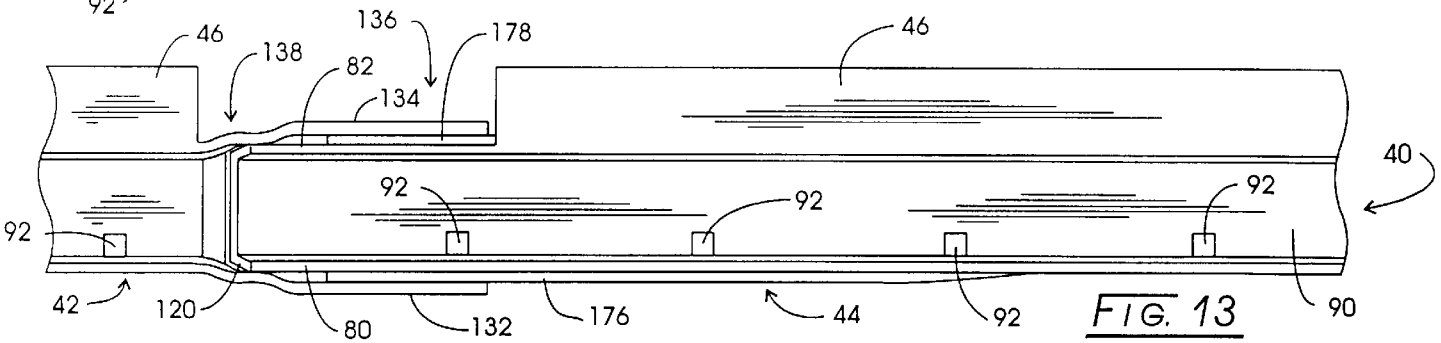
FIG. 13 is a bottom viw of the split ring clamp of FIG. 11.

Referring to FIGS. 11, 12, and 13, the structure of split ring 42 and associated pivot arm 44 are revealed at a higher level of detail. As seen in FIGS. 12 and 13, ring 42 has a first end or first end region represented generally at 120. Integrally formed at this first end region 120 is an outwardly extending toe 122 with a rearwardly extending contact surface 124. The term "rearwardly" as used herein is considered to be in the direction toward an opposite end of the ring 42 from one or the other end, for example, end 120. The term "forwardly" as used herein is considered in the direction away from the opposite or other end. The second end or second end region of the split ring 42 is represented generally at 126 (FIG. 11) and is seen to include an integrally formed receiver channel 128 (FIG. 11) and a receiver channel opening 130 formed therein. Receiver channel 128 is formed having oppositely-disposed spaced-apart sides 132 and 134 (FIGS. 11 and 13) which function to define the opening 130 and which have mutually inwardly facing internal surfaces which are spaced apart at a first region represented generally at 136 selected to slide over the oppositely-disposed sides of the ring pivot arm 44. Those same spaced-apart sides then are spaced apart a second distance at region 138 so as to be slideably movable over the ring upper and lower flange portions 80 and 82 in a closely nesting relationship. This necked down configuration as seen in FIGS. 11 and 13 aids in the integrity of closure by eliminating play or looseness at the union of the first and second ends of the split ring 42. FIG. 12 reveals that the receiver channel 128 includes an integrally formed and inwardly depending toe 140 which is rearwardly disposed from opening 130 and which includes a rearwardly facing second contact surface 142. FIG. 12 shows a closed orientation for the ring clamp 40 such that the contact surfaces 124 and 142 are seen to be in mutual abutment. The toes 122 and 142 extend across the first and second ends 120 and 126, and the contact surfaces 124 and 142 are in a stress transfer relationship aiding in the accommodation of a substantial portion of tensile stress asserted by the clamp 40 when closed about a drum in the manner of FIG. 1. Surfaces 124 and 142 are slightly canted for the purpose of facilitating their engagement during the closure procedure associated with developing clamping.

As seen in FIGS. 11 and 12 sides 132 and 134 of receiver channel 128 extend forwardly to support a ring pivot shaft 144 which located outwardly of the tip of the receiver channel 128. FIG. 12 reveals that the ring pivot shaft 144 is non-circular in cross-section, being shown having an oval or ellipse (cross-sectional) shape with the principal dimension being aligned with the direction of tensile stress experienced by the clamp 40. Note, additionally, that the shaft 144 is configured having a capture groove 146 extending thereacross (see also FIG. 15). The oval shape of the ring pivot shaft 144 improves the strength of the clamp in the direction of principal stress and, in combination with the capture groove 146, provides an improved capture of the shaft 144 within the pivot arm 44. The capture groove, in particular, maintains the coupling of the arm 44 with the second end of ring 42 when in a fully open or pre-clamping mode.

Returning to the first end region 120 FIGS. 11 and 12 reveal an outwardly extending, rearwardly opening pivot shaft receiving notch 148 which is integrally formed rearwardly of the outer tip of first end 120 of ring 42. FIG. 11 reveals that at either side of the receiving notch 148, there is integrally formed a sloping ring contact surface as at 150 and 152. When the clamp 40 is in a pre-clamping or open mode, the surfaces 150 and 152 are abuttably engaged with corresponding abutting portions 154 and 156 on the outwardly disposed surfaces of pivot arm 44 (see also FIG. 14). The tip region 120 also carries an integrally formed dog or latch component 160 which extends outwardly from the outer band portion 84 to engage a recess ledge seen in FIG. 11 at 162 when the clamp 40 is in a closed orientation. Latch component 160 has a circular opening 164 formed therein for the purpose of permitting passage of a locking component such as a lock, heavy wire, or the like.

Figure 14:
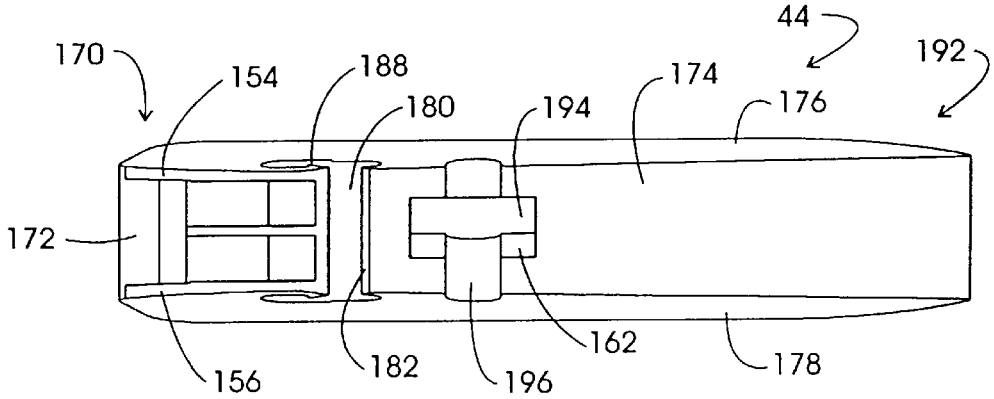
FIG. 14 is a top view of the pivot arm employed with the clamping system of the invention.
Figure 15:
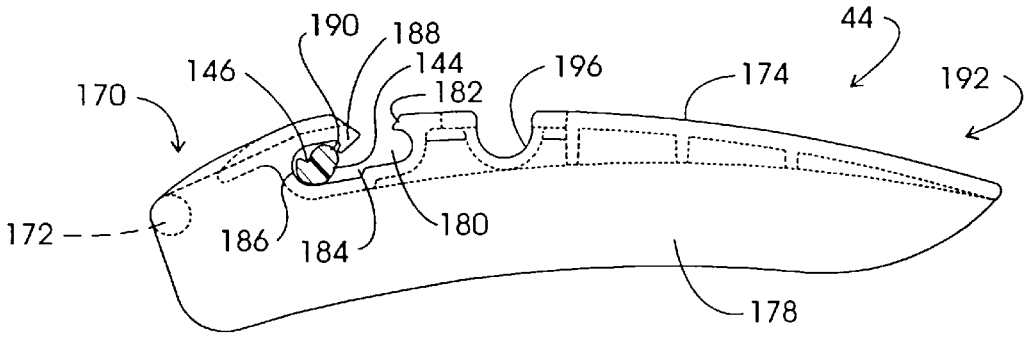
FIG. 15 is a side view of the pivot arm employed with the clamping system of the invention further showing a ring pivot shaft with which it cooperates.
Figure 16:
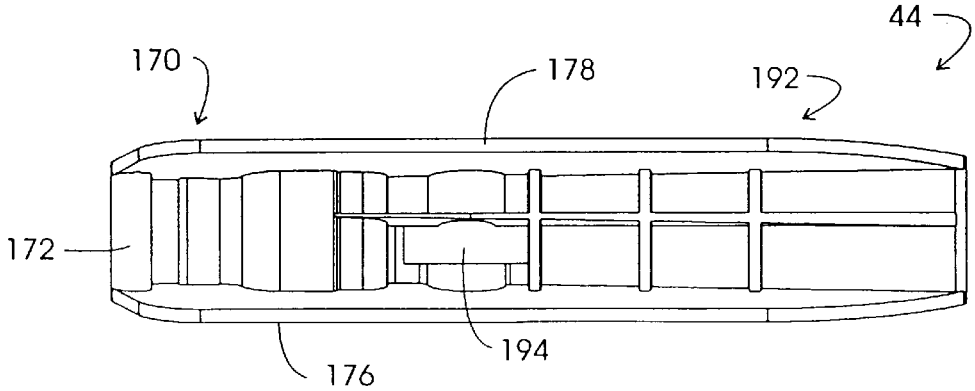
FIG. 16 is a bottom view of the pivot arm of FIG. 14.

Now looking to the structure of the pivot arm 44, and looking additionally to FIGS. 14–16, it may be observed that the arm is formed having a pivot end represented generally at 170 which supports integrally formed, transversely disposed arm pivot shaft 172. Shaft 172 is pivotally engaged within pivot shaft receiving notch 148. Pivot arm 44 is formed of polymeric material in somewhat of a channel form having an outer portion or surface 174 and sides 176 and 178. Spaced from the arm pivot shaft 172 is a ring pivot shaft receiving notch 180 with an associated shaft access opening 182. Opening 182 is of lesser widthwise extent than the principal dimension of ring pivot shaft 144. As such, the shaft 144 must be oriented with its principal dimension relatively perpendicular with respect to the receiving notch opening 182 in order to be removed or inserted. Notch 180 further is configured having an entrance channel 184 which initially is of dimensional extent less than the shaft 144 principal dimension but then expands to permit rotation of shaft 144. Thus, the shaft 144 may slide within the entrance channel 184 when it is in the orientation shown in FIG. 12. Entrance channel 184 extends to a shaft bearing surface 186 which, in the closed orientation shown in FIG. 12, functions to compressively abut against one side of shaft 144. The shaft 144, however, may change its relative orientation with respect to channel 184 by virtue of the noted enlargement of the outwardly disposed dimension of the channel in the vicinity of bearing surface 186. The shaft bearing surface 186 is spaced from the arm pivot shaft 172 a distance selected for drawing together the first and second ends of the split ring 42 to an extent effective to cause the abutting, stress transfer engagement of the earlier-noted contact surfaces 124 and 142 as the clamp 40 is closed. FIGS. 12 and 15 reveal that the ring pivot shaft receiving notch 180 is configured at its entrance opening 182 to have a capturing pawl 188 having an engaging edge 190. When the ring 40 is in a pre-clamping or open mode, the engaging edge 190 of pawl 188 will be in engagement with the capture groove 146 of shaft 144. This prevents the ring second end 126 from releasing from engagement with the pivot arm during the noted preclamping or open mode or configuration.

Pivot arm 44 extends from notch 180 to form a lever portion represented generally at 192. Within this lever portion 192, the locking detent assembly comprised of latch component 160 and ledge 162 is completed with the provision of a rectangular opening 194 extending through the outer portion 174 as well as the provision of a transversely disposed, cylindrically shaped cylindrical channel 196 (see FIGS. 11, 12, and 14). With the arrangement shown, when the pivot arm 44 is fully closed, the circular opening of latch component 160 and the channel 196 are aligned for receiving some form of locking device. FIGS. 11 and 14–16 further reveal that the outer sides of the arm 44 are slightly outwardly canted and nest over the outer surfaces of split ring 42 when in the closed orientation of FIGS. 11–13.

Figure 17:
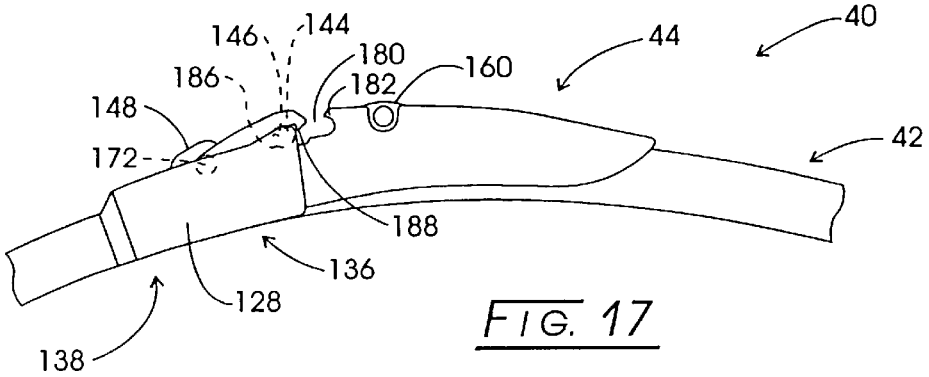
FIG. 17 is a partial side view of the split ring clamp employed with the closure system of the invention showing it in a closed orientation.
Figure 18:
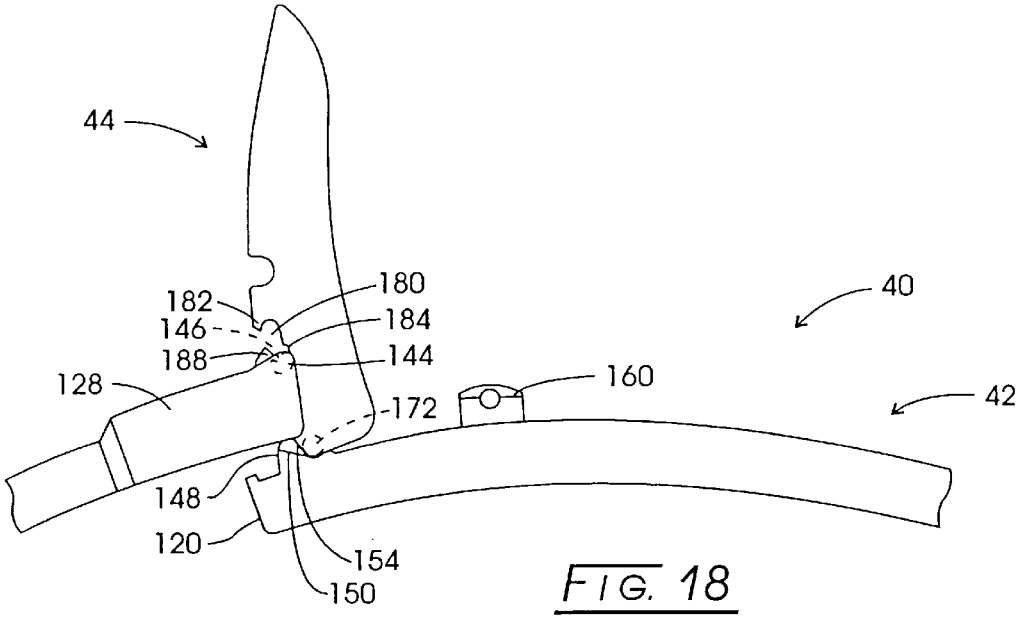
FIG. 18 is a partial side view of the clamp of FIG. 17 showing its orientation while being open.
Figure 19:
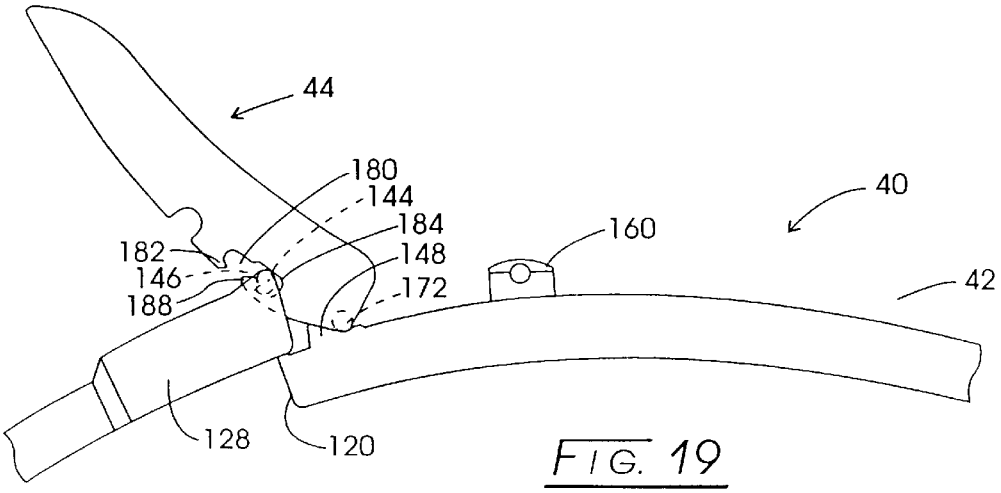
FIG. 19 is a partial side view of the clamp of FIG. 17 showing it in a pre-clamping mode or open orientation.

FIGS. 17–19 illustrate the orientations of the components of the clamp 40 when manipulated from a closed to an open orientation. In FIG. 17, the clamp is in a closed orientation wherein latch component 160 is engaged with recess ledge 162. The side portions of receiver channel 128 at region 136 nest over the sides of pivot arm 44 and the receiver channel 128 further is necked down such that the sides thereof at region 138 nest over the first end region 122 of the ring 42 (see also FIG. 13). The ring pivot shaft 144 is retained against shaft bearing surface 186 and the capture groove formed within shaft 186 is pointing toward the bearing surface 186 of the ring pivot shaft receiving notch 180.

Looking to FIG. 18, the latch component 160 has been flexed to release the arm 44 and the arm is seen in a somewhat vertical orientation. The arm 44 has been rotated about the pivot shaft receiving notch 148 by virtue of the engagement of the ring pivot shaft 172 therein. The oval cross-section shaped ring pivot shaft 144 is oriented such that its principal dimension is perpendicular to the ring pivot shaft receiving notch 180 of shaft access opening 182. This relative orientation is available inasmuch as the entrance channel 184 of the notch 180 is of expanded dimension. It may be observed that this is the orientation for connecting the ring pivot shaft 144 into the ring pivot shaft receiving notch 180.

Continued pivoting of the arm 44 is available but, as seen in FIG. 19, only to the extent limited by the sloping ring contact surfaces 150 and 152. In this regard, the abutting portions on the arm 44 as described at 154 and 156 respectively contact those contact surfaces 150 and 152. Thus, the arm 44 is retained in the orientation seen in FIG. 19. Of importance, however, the capture groove now engages the capturing pawl 188. This engagement prevents any separation of the ring pivot shaft 144 from the ring pivot shaft receiving notch 180. The stresses imposed from the shaft 144 upon the pawl 188 are in alignment with the first and second end regions of the ring 42.

Since certain changes may be made in the above apparatus and system without departing from the scope of the invention herein involved, it is intended that all matter contained in the above description or shown in the accompanying drawings shall be interpreted as illustrative and not in a limiting sense.

We claim:

1. A closure system for providing a removable closure over a container having a top structure with an upwardly disposed container rim and inwardly and outwardly disposed wall surfaces, comprising:

a molded lid, including:

a lid top portion extending to an outer periphery locatable adjacent said container top structure;

an annular lid rim structure integrally formed with said lid top portion at said outer periphery, having a ring band locatable in adjacency with said container inwardly disposed wall surface, an annular concave closure cavity for nestably receiving said container rim and having an annular, outwardly disposed flange portion, and said outwardly disposed flange portion being configured having a lower disposed annular outer flange surface and a restraining notch disposed upwardly and inwardly from said outer flange surface; and a split ring clamp for retaining said lid upon said container, including:

an inwardly opening channel-form ring formed of polymeric material with upper and lower side flange portions extending inwardly from an outer band portion with corresponding inwardly disposed surfaces mountable over said annular rim structure, and a twist inhibiting blocking component extending inwardly from said outer band portion inwardly disposed surface and located for mutually abutting contact with a surface of said restraining notch, said ring having oppositely disposed first and second ends, said first end having an outwardly extending pivot shaft receiving notch opening rearwardly toward said second end, said ring second end including a receiver channel having oppositely disposed spaced-apart sides defining an opening, said spaced apart sides having mutually inwardly facing internal surfaces moveable over said upper and lower side flange portions at said first end and including a ring pivot shaft extending between said spaced apart sides forwardly of said opening; and a ring pivot arm having a pivot end with a transversely disposed arm pivot shaft, a ring pivot shaft receiving notch having a shaft access opening extending to a shaft bearing surface spaced from said arm pivot shaft a distance selected for drawing together said ring first and second ends, said arm pivot shaft being configured for pivotal engagement with said pivot shaft receiving notch, and said ring pivot shaft receiving notch being configured for receiving said second end ring pivot shaft.

2. The closure system of claim 1 in which said ring band extends upwardly to provide an annular lid stacking ledge.

3. The closure system of claim 1 in which:

said ring pivot arm includes oppositely disposed sides and a top extending from said pivot end;

said ring pivot arm oppositely disposed sides are extensible over said ring upper and lower side flange portions along a portion of said first end; and said receiver channel oppositely disposed spaced apart sides are spaced apart a fist distance for sideable movement over said ring pivot arm oppositely disposed sides and said spaced apart sides are spaced a part a second distance less than said first distance for slideable movement over said ring upper and lower flange portions along a second portion of said first end.

4. The closure system of claim 1 in which said split ring clamp includes:

an annular secondary connection flange extending transversely outwardly from the inwardly disposed edge of said lower side flange portion for abuttable engagement with said container outwardly disposed wall surface; and a band retainer assembly mounted upon said secondary connection flange for slideably receiving and retaining a banding strap.

5. The closure system of claim 4 in which:

said band retainer assembly comprises a sequence of spaced apart belt loops integrally formed at the outwardly disposed surface of said secondary connection flange.

6. The closure system of claim 1 in which said annular lid rim structure concave closure cavity includes an upwardly disposed concave annular seal retainer cavity; and including a polymeric gasket removably insertable within said seal retainer cavity.

7. The closure system of claim 6 in which said seal retainer cavity is of circular cross-section of predetermined cavity radius, having a cylindrical surface extent subtending an angle greater than 180° and less than 360°.

8. The closure system of claim 1 in which:

said lid rim structure outwardly disposed flange portion extends to a lower edge positioned in abuttable adjacency with said inwardly disposed surface of said ring lower side flange portion; and said restraining notch includes an upstanding annular surface located along the inwardly disposed side of an inwardly disposed annular ledge formed within said rim structure outwardly disposed flange portion.

9. The closure system of claim 8 in which said restraining notch upstanding annular surface is disposed inwardly from said lower disposed annular outer flange structure a distance providing a pivot position upon the abutment of said restraining notch and said blocking component, with respect to upward twisting force imposed upon said lid, which is effective to promote an abutting compressive engagement of said outwardly disposed flange portion lower edge with said inwardly disposed surface of said ring lower side flange portion.

10. The closure system of claim 9 in which said blocking component includes an inwardly disposed surface on a sequence of regularly spaced blocking gusset protuberances located adjacent the said inwardly disposed surfaces of said ring outer band portion and upper side flange portion.

11. The closure system of claim 10 in which said blocking gusset protuberances are radially spaced about said ring outer band portion in increments of about 10°.

12. The closure system of claim 1 in which:

said channel-shaped ring first end includes a zing contact surface;

said ring pivot shaft includes a capture groove opening rearwardly toward said first end;

said ring pivot arm includes a capturing pawl formed within said ring pivot shaft receiving notch having an engaging edge; and said split ring clamp having a pre-clamping mode in which said ring pivot arm is pivoted to an orientation wherein said ring pivot arm abutting portion is in abutting engagement with said ring contact surface and said capturing pawl is engaged with said capture groove.

13. The closure system of claim 12 in which said ring contact surface slopes downwardly toward said ring first end at an angle positioning said ring pivot arm, when in said pre-clamping mode, in an orientation aligning said capture groove with said capturing pawl engaging edge.

14. The closure system of claim 12 in which said capturing pawl is located adjacent a side of said shaft access opening of said pivot shaft receiving notch, said engaging edge facing said shaft bearing surface.

15. The closure system of claim 14 in which said ring contact surface is formed as a shoulder component of said pivot shaft receiving notch.

16. A split ring clamp for retaining a lid on the rim of a container at the interface therebetween, comprising:

an inwardly opening channel-shaped ring formed of polymeric material with upper and lower side flange portions extending inwardly from an outer hand portion with respective upper, lower, and band inner and outer surfaces, said ring having oppositely disposed first and second ends, said first end having an outwardly extending pivot shaft receiving notch opening rearwardly toward said second end and a ring contact surface, said ring second end including a receiver channel having oppositely disposed spaced apart sides defining an opening, said spaced apart sides having mutually inwardly facing internal surfaces movable over said upper and lower flange portions at said first end and including a ring pivot shaft extending between said spaced apart sides forwardly of said opening and having a capture groove formed therein opening rearwardly toward said first end; and a channel-shaped ring pivot arm having oppositely disposed sides and a top extending from a pivot end with a transversely disposed arm pivot shaft said top including an abutting portion, a ring pivot shaft receiving notch having a shaft access opening extending to a shaft bearing surface spaced from said arm pivot shaft a distance for drawing together said ring first and second ends and extending therefrom to form a lever, a capturing pawl formed within said ring pivot shaft receiving notch having an engaging edge, said arm pivot shaft being configured for pivotal engagement with said ring first end pivot shaft receiving notch, said ring pivot shaft receiving notch being configured for receiving said second end ring pivot shaft, said split ring clamp having a pre-clamping mode in which said ring pivot arm is pivoted to an orientation wherein said ring pivot arm abutting portion is in abutting engagement with said ring contact surface and said capturing pawl is engaged with said capture groove, said split ring clamp having a clamping mode in which said ring pivot arm is pivoted to an orientation wherein said ring pivot shaft is abuttably engaged with said shaft bearing surface and said internal surfaces of said receiver channel are positioned over said upper and lower flange portions at said first end.

17. The split ring clamp of claim 16 in which said capturing pawl is located adjacent a side of said shaft access opening of said pivot shaft receiving notch, said engaging edge facing said shaft bearing surface.

18. The split ring clamp of claim 16 in which:

said ring pivot arm oppositely disposed sides extend over said ring upper and lower side flange portions along a first portion of said first end when said split ring clamp is oriented in said clamping mode; and said receiver channel oppositely disposed spaced apart sides are spaced apart a first distance for slideable movement over said ring pivot arm oppositely disposed sides and said spaced apart sides are spaced apart a second distance less than said first distance for slideable movement over said ring upper and lower flange portions along a second portion of said first end when said split ring clamp is oriented in said clamping mode.

19. The split ring clamp of claim 16 in which said ring contact surface slopes downwardly toward said ring first end at an angle positioning said ring pivot arm, when in said pre-clamping mode, in an orientation aligning said capture groove with said capturing pawl engaging edge.

20. The split ring clamp of claim 19 in which said ring contact surface is formed as a shoulder component of said pivot shaft receiving notch.

21. The split ring clamp of claim 20 in which said ring pivot arm abutting portion is located in alignment with a said ring pivot arm side.

22. A container assemblage, comprising:

a polymeric container having a top structure with an upwardly disposed container rim and inwardly and outwardly disposed wall surfaces;

a molded lid, including:

a lid top portion extending to an outer periphery locatable adjacent said container top structure, and an annular lid rim structure integrally formed with said lid top portion at said outer periphery, having a ring band locatable in adjacency with said container inwardly disposed wall surface, an annular generally concave closure cavity for nestable positioning upon said container rim and having an annular, outwardly disposed flange portion, said outwardly disposed flange portion being configured having a lower disposed annular outer flange surface and a restraining notch disposed upwardly and inwardly from said outer flange surface, a concave annular seal retainer cavity upwardly disposed within said concave closure cavity, and a polymeric gasket removably insertable within said seal retainer cavity; and a split ring clamp for retaining said lid upon said container, including:

an inwardly opening channel-form ring formed of polymeric material with upper and lower side flange portions extending inwardly from an outer band portion with respective upper, lower and band inner and outer surfaces, said ring being mountable over said annular rim structure, said ring having oppositely disposed first and second ends, said first end having an outwardly extending pivot shaft receiving notch opening rearwardly toward said second end and a ring contact surface, a twist inhibiting blocking component extending inwardly from said outer band portion inwardly disposed surface and located for mutually abutting contact with a surface of said restraining notch, said ring second end including a receiver channel having oppositely disposed spaced-apart sides having mutually inwardly facing internal surfaces movable over said upper and lower side flange portions at said first end and including a ring pivot shaft extending between said spaced apart sides forwardly of said opening and having a capture groove formed therein, and a ring pivot arm having oppositely disposed sides and a top, extending from a pivot end and with a transversely disposed arm pivot shaft, said top including an abutting portion, a ring pivot shaft receiving notch having a shaft access opening extending to a shaft bearing surface spaced from said arm pivot shaft a distance for drawing together said ring first and second ends and extending therefrom to form a lever, a capturing pawl formed within said ring pivot shaft receiving notch having an engaging edge, said arm pivot shaft being configured for pivotal engagement with said ring first end pivot shaft receiving notch, said ring pivot shaft receiving notch being configured for receiving said second end pivot shaft, said split ring clamp having a pre-clamping mode in which said ring pivot arm is pivoted to an orientation wherein said ring pivot arm abutting portion is in abutting engagement with said ring sloping contact surface and said capturing pawl is engaged with said capture groove, said split ring clamp having a clamping mode in which said ring pivot arm is pivoted to an orientation wherein said ring pivot shaft is abuttably engaged with said shaft bearing surface and said internal surfaces of said receiver channel are positioned over said upper and lower flange portions at said first end.

23. The container assemblage of claim 22 in which said concave annular seal retainer cavity is of circular cross section of predetermined cavity radius and has a cylindrical surface extent subtending a radius angle greater than 180° and less than 360°; and said polymeric gasket is of circular cross section with a gasket radius corresponding with said cavity radius.

24. The container assemblage of claim 22 in which said upwardly disposed container rim is configured having an upstanding annular expansion rib extensible in expanding relationship into said polymeric gasket when said molded lid is mounted upon said container rim.

25. The container assemblage of claim 22 in which said split ring clamp includes:

an annular secondary connection flange extending transversely outwardly from the inwardly disposed edge of said lower side flange portion for abuttable engagement with said container outwardly disposed wall surface; and a band retainer assembly mounted upon said secondary connection flange for slideably receiving and retaining a banding strap.

26. The container assemblage of claim 22 in which:

said lid rim structure outwardly disposed flange portion extends to a lower edge positioned in abuttable adjacency with said inwardly disposed surface of said ring lower side flange portion; and said restraining notch is an annular surface located along the inwardly disposed side of an annular ledge formed within said rim structure outwardly disposed flange portion.

27. The container assemblage of claim 26 in which said restraining notch is disposed inwardly from said lower disposed annular outer flange structure a distance providing a pivot position at the abutment of said restraining notch and said blocking component, with respect to upward twisting force imposed upon said lid, which is effective to promote an abutting compressive engagement of said outwardly disposed flange portion lower edge with said inwardly disposed surface of said ring lower side flange portion.

28. A container assemblage, comprising:

a container having a top structure with an upwardly disposed annular container rim and inwardly and outwardly disposed wall surfaces;

a molded lid, including:

a lid top portion extending to an outer periphery locatable adjacent said container top structure, an annular lid rim structure integrally formed with said lid top portion at said outer periphery, having an annular generally concave closure cavity for nestable positioning upon said container rim and having an annular, outwardly disposed flange portion, a concave annular seal retainer cavity upwardly disposed within said concave closure cavity having an annular seal access slot extending along said closure cavity of radial widthwise dimension selected for the press fit insertion of a flexible gasket into said seal retainer cavity and having a seal retainer principal radial widthwise dimension greater than said access slot widthwise dimension; and a polymeric deformable gasket, having a principal widthwise dimension corresponding with said seal retainer principal radial widthwise dimension, removably slidably insertable through said access slot into said seal retainer cavity and protrudable through said access slot when within said seal retainer cavity to effect contacting sealing communication with said container rim.

29. The container assemblage of claim 28 in which said polymeric deformable gasket is an extruded flexible polymeric skin having a flexible foamaceous core.

30. A split ring clamp for retaining a lid on the rim of a container at the interface there between, comprising:

an inwardly opening channel-shaped ring formed of polymeric material with upper and lower side flange portions extending inwardly from an outer band portion with respective upper, lower, and band inner and outer surfaces, said ring having oppositely disposed first and second ends, said first end having an outwardly extending pivot shaft receiving notch opening rearwardly toward said second end and a ring contact surface, said ring second end including a receiver channel having oppositely disposed spaced apart sides defining an opening, said spaced apart sides having mutually inwardly facing internal surfaces movable over said upper and lower flange portions at said first end and including a ring pivot shaft extending between said spaced apart sides forwardly of said opening and having a capture groove formed therein opening rearwardly toward said first end, an annular secondary connection flange extending transversely outwardly from the inwardly disposed edge of said lower side flange portion, and a band retainer assembly mounted upon said secondary connection flange for slideably receiving and retaining a banding strap; and a channel-shaped ring pivot arm having oppositely disposed sides and a top extending from a pivot end with a transversely disposed arm pivot shaft said top including an abutting portion, a ring pivot shaft receiving notch having a shaft access opening extending to a shaft bearing surface spaced from said arm pivot shaft a distance for drawing together said ring first and second ends and extending therefrom to form a lever, a capturing pawl formed within said ring pivot shaft receiving notch having an engaging edge, said arm pivot shaft being configured for pivotal engagement with said ring first end pivot shaft receiving notch, said ring pivot shaft receiving notch being configured for receiving said second end ring pivot shaft, said split ring clamp having a pre-clamping mode in which said ring pivot arm is pivoted to an orientation wherein said ring pivot arm abutting portion is in abutting engagement with said ring contact surface and said capturing pawl is engaged with said capture groove, said split ring clamp having a clamping mode in which said ring pivot arm is pivoted to an orientation wherein said ring pivot shaft is abuttably engaged with said shaft bearing surface and said internal surfaces of said receiver channel are positioned over said upper and lower flange portions at said first end.

31. The split ring clamp of claim 30 in which said band retainer assembly comprises an array of spaced apart belt loops integrally formed at the outwardly disposed surface of said secondary connection flange.

32. A container assemblage, comprising:

a container having a top structure with an upwardly disposed annular container rim and inwardly and outwardly disposed wall surfaces;

a molded lid, including:

a lid top portion extending to an outer periphery locatable adjacent said container top structure, an annular lid rim structure integrally formed with said lid top portion at said outer periphery, having an annular generally concave closure cavity for nestable positioning upon said container rim and having an annular, outwardly disposed flange portion, a concave annular seal retainer cavity upwardly disposed within said concave closure cavity, said concave annular seal retainer cavity being of circular cross section of predetermined cavity radius and having a diameter of predetermined dimension, said seal retainer cavity having a partial cylindrical surface extent subtending a cavity radius defined angle greater than 180° and less than 360° to establish an annular seal access slot of widthwise dimension selected for the insertion of a flexible gasket within said seal retainer cavity; and polymeric deformable gasket, having a principal widthwise dimension corresponding with said predetermined dimension, removably slidably insertable through said access slot into said seal retainer cavity and accessable at said access slot when within said seal retainer cavity to effect contacting sealing communication with said container rim.

33. The container assemblage of claim 32 in which said upwardly disposed container rim is configured having an upstanding annular expansion rib extensible in expanding relationship into said polymeric gasket when said molded lid is mounted upon said container rim.

34. The container assemblage of claim 32 in which said upwardly disposed container rim is configured having an upstanding annular expansion rib extensible in expanding relationship into said polymeric gasket when said molded lid is mounted upon said container rim.

* * * * *